US005284106A

United States Patent [19]

Meng

[11] Patent Number: 5,284,106

[45] Date of Patent: Feb. 8, 1994

[54] SUPERCONDUCTING ELECTROMAGNETIC TORPEDO LAUNCHER

[75] Inventor: James C. S. Meng, Portsmouth, R.I.

[73] Assignee: The United States of America as represented by the Secretary of the Navy, Washington, D.C.

[21] Appl. No.: 16,349

[22] Filed: Feb. 11, 1993

[51] Int. Cl.[5] ..... B63H 19/00

[52] U.S. Cl. ..... 114/238

[58] Field of Search ..... 440/6, 3, 5, 38, 39, 440/40, 41, 42, 43, 44, 47; 60/202, 203.1, 221; 114/238, 239; 417/50

[56] References Cited

U.S. PATENT DOCUMENTS

| | | | |
|---|---|---|---|
| 4,523,538 | 6/1985 | Hollmann et al. | 114/238 |
| 4,971,949 | 11/1990 | Laskaris et al. | 114/238 |
| 5,099,745 | 3/1992 | Hubbell et al. | 114/238 |

FOREIGN PATENT DOCUMENTS

| | | | |
|---|---|---|---|
| 71794 | 4/1987 | Japan | 440/38 |
| 235796 | 10/1991 | Japan | 440/38 |
| 279096 | 12/1991 | Japan | 440/38 |
| 9014265 | 11/1990 | World Int. Prop. O. | 440/6 |

*Primary Examiner*—Andres Kashnikow
*Assistant Examiner*—Stephen P. Avila
*Attorney, Agent, or Firm*—Michael J. McGowan; Prithvi C. Lall; Michael F. Oglo

[57] ABSTRACT

A torpedo launching system with a magnetohydrodynamic (MHD) pump for torpedo launches is disclosed. The system comprises a sea chamber, impulse tank and launch tube. The impulse tank has a magnetohydrodynamic pump which provides a Lorentz force to the seawater within the impulse tank thereby launching the torpedo. The MHD pump comprises supercooled superconducting electromagnets and seawater electrodes set up to provide perpendicular electric and magnetic fields.

1 Claim, 2 Drawing Sheets

SUPERCONDUCTING ELECTROMAGNETIC TORPEDO LAUNCHER

STATEMENT OF GOVERNMENT INTEREST

The invention described herein may be manufactured and used by or for the Government of the United States of America for Governmental purposes without the payment of any royalties thereon or therefor.

CROSS REFERENCES TO RELATED PATENT APPLICATIONS

The instant application is related to my four co-pending U.S. patent applications entitled SUPERCONDUCTING ELECTROMAGNETIC THRUSTER (U.S. Ser. No. 08/016324); MAGNETOSTRICTIVE BOUNDARY LAYER CONTROL SYSTEM (U.S. Ser. No. 08/016325); SEAWATER MAGNETOHYDRODYNAMIC TEST APPARATUS (U.S. Ser. No. 08/016328); and ACTIVE TURBULENCE CONTROL USING MICROELECTRODES, PERMANENT MAGNETS IN MICROGROOVES (U.S. Ser. No. 08/016326) having same filing date.

BACKGROUND OF THE INVENTION (1) Technical Field of the Invention

The invention relates to torpedo launching devices and more particularly to torpedo launchers using seawater electromagnetic fluid pumps.

(2) Description of the Prior Art

A conventional torpedo launching system uses a ram pump assembly having a water cylinder and piston arrangement which drives a seawater charge through a series of chambers and out the muzzle end of the torpedo launch tube.

The seawater charge carries the torpedo out of the launch tube thereby effecting the launch. The conventional system has numerous drawbacks which create operational limitations. Among these drawbacks, mechanical complexity of the entire system including pneumatic actuators for the water piston, flood and drain system for loading and unloading, and a pressurized air source to power the pneumatic system result in maintenance and reliability problems. Additionally, the large moving assemblies and structure of the conventional ram pump assembly increases the vulnerability of the hull in the case of contact damage. Finally, the conventional ram pump assembly is a significant noise source which reduces the stealth characteristics of a submarine.

SUMMARY OF THE INVENTION

Accordingly, it is an object of the present invention to provide a torpedo launching system having no moving parts for pumping seawater.

It is a further object of the present invention to provide a reduced noise signature torpedo launching system having a mechanically simple design.

The invention is a novel system for launching torpedoes using a magnetohydrodynamic pump to drive a seawater charge through the torpedo launcher. A superconducting electromagnet produces an intensified magnetic field which interacts with an electric field. This interaction produces a Lorentz force, acting perpendicular to both electric and magnetic fields, which then drives the seawater through the torpedo launching system. The only moving parts are muzzle and breech doors, vents and drains. There is no moving hardware associated with the pumping of seawater.

BRIEF DESCRIPTION OF THE DRAWINGS

A more complete understanding of the present invention and the attendant advantages therein may be gained from the following specification when read With reference to the appended drawings wherein.

DESCRIPTION OF THE PREFERRED EMBODIMENTS

Figure 1:
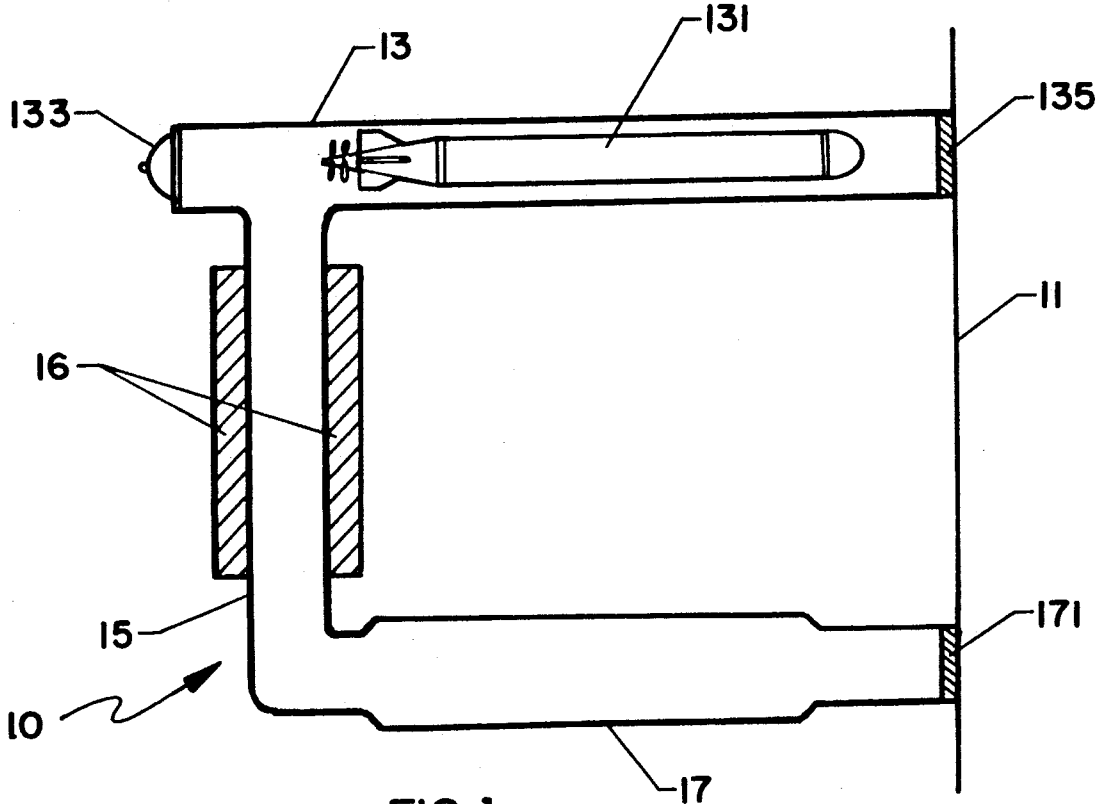
FIG. 1 is a schematic representation of a section of a submarine hull showing the layout of the torpedo launching system of the present invention.

Referring now to FIG. 1, the torpedo launching system of the present invention, denoted generally by the reference numeral 10, is shown schematically illustrating the major components and layout within hull 11 of a submarine. A launch tube 13 containing torpedo 131 is connected to impulse tank 15 which is further connected to sea chamber 17. Seawater is admitted to the launcher through sea chamber door 171 flowing into sea chamber 17 through impulse tank 15 and exiting to the sea through launch tube 13. Torpedo 131 is launched by the expelled charge of seawater. Launch tube 13 has the conventional associated mechanisms including breech door 133 and muzzle door 135. Other mechanisms, not shown, include the venting and the flood and drain system. Also, not shown is the slide valve assembly which isolates the impulse tank 15 from the launch tube 13 during loading operations. Impulse tank 15 houses the magnetohydrodynamic pump 16 used to drive the seawater charge through the launcher.

Figure 2:
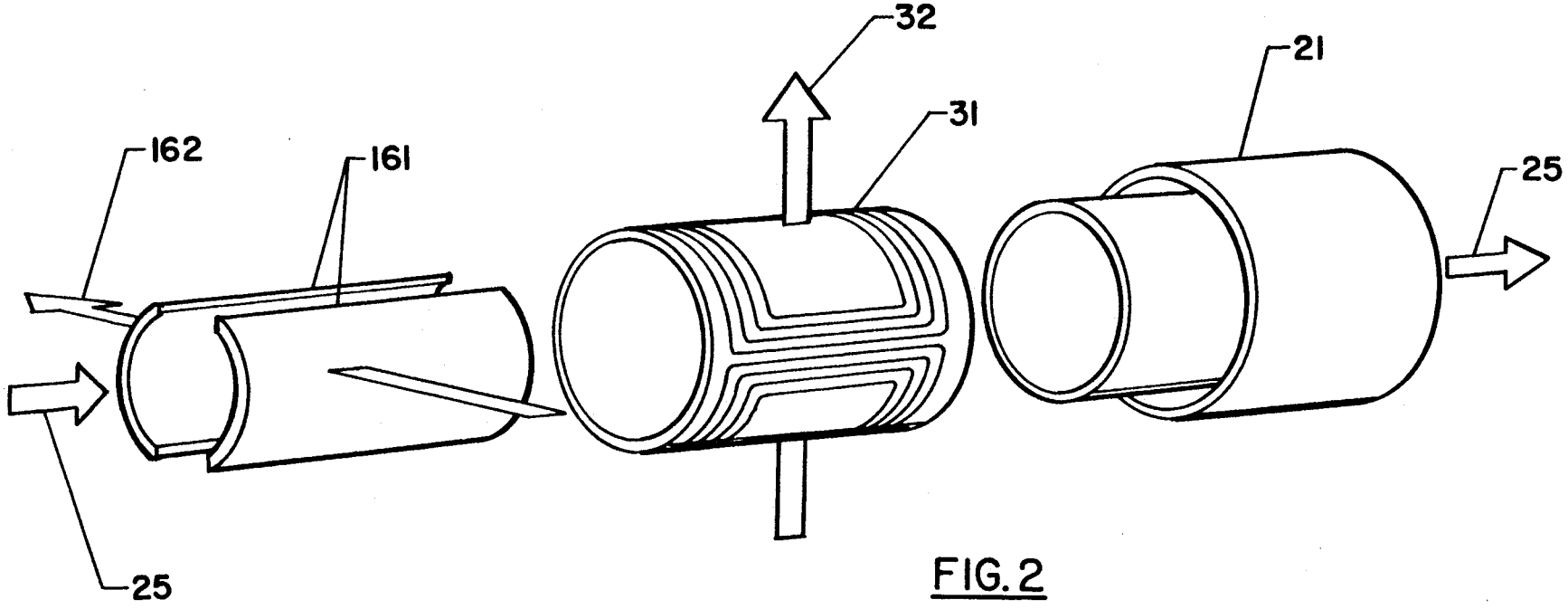
FIG. 2 is an exploded view of the magnetohydrodynamic pump which powers the launcher.

Referring now to FIG. 2, the elements of the magnetohydrodynamic pump are shown in an exploded view. Electrodes 161 are embedded in the inner wall of the impulse tank allowing a high current density electric field to form across the diameter of the impulse tank as represented by electric field vector 162. The impulse tank and electric field mechanism is surrounded by cryogenic dewar 21. The dewar provides a sealed low temperature environment using liquid helium as a refrigerant. Superconducting coils 31 are located within dewar 21 and operate to form intensified magnetic field 32.

The interaction of electric field 162 and magnetic field 32 produces a Lorentz force driving the seawater within the impulse tank 15 axially through the impulse tank as represented by arrow 25 and thereby launching torpedo 131. Numerous benefits result from the operation of this launcher when compared to a conventional launcher. First, the mechanical complexity is greatly reduced since the pumping mechanism has no moving parts. Additionally, misalignment, bending and other damage is less of a problem since there is no mechanical water piston. Further, the noise of the entire operation is much less. There is no water hammer effect caused by seawater slamming against a water piston. There is no mechanical noise from movement of water pistons or air pistons.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A torpedo launching system comprising:

a launch tube having a breech door and a muzzle door;

an impulse tank constructed of a non-conducting material and having an intake and an exit end, said exit end connected to said launch tube near its breech end;

a sea chamber for admitting seawater to the torpedo launching system being connected to the intake of said impulse tank on a first end and ported to the sea on a second end;

seawater electrodes embedded in the inner walls of said impulse tank thereby providing an electric field across the diameter of said impulse tank;

a cryogenic dewar surrounding said impulse tank providing a low temperature environment cooled by liquid helium; and a super-conducting electromagnet located within said dewar and providing an intensified magnetic field across said impulse tank oriented so that a Lorentz force is generated in the seawater within said impulse tank.

* * * * *